US005503172A

United States Patent [19]

Hedeen et al.

[11] Patent Number: 5,503,172

[45] Date of Patent: Apr. 2, 1996

[54] DISHWASHER MACHINE TUB WITH LOCALIZED NOISE ATTENUATION

[75] Inventors: Robert A. Hedeen, Clifton Park; Omer L. Ari, Troy, both of N.Y.

[73] Assignee: General Electric Company, Schenectady, N.Y.

[21] Appl. No.: 386,530

[22] Filed: Feb. 6, 1995

[51] Int. Cl.[6] ..... A47L 15/42

[52] U.S. Cl. ..... 134/183; 134/200; 181/200

[58] Field of Search ..... 134/182, 183, 134/56 D, 57 D, 58 D, 176, 179, 200; 181/200, 207, 208

[56] References Cited

U.S. PATENT DOCUMENTS 2,448,490 8/1948 Karlstrom ..... 134/182

FOREIGN PATENT DOCUMENTS 2347252 3/1975 Germany ..... 134/182

*Primary Examiner*—Philip R. Coe

*Attorney, Agent, or Firm*—Douglas E. Erickson; Paul R. Webb, II

[57] ABSTRACT

A dishwasher machine tub for containing water sprayed therein during operation of a dishwasher. The tub includes a wall, a door, and a first wall plate. The wall defines a dishwashing chamber having an opening. The door is connected to the wall and may be positioned to cover and uncover the opening. The first wall plate is spaced apart from the wall, resiliently connected to the wall, and positioned within the chamber. Preferably, the first wall plate is positioned so as to be directly impinged by some of the sprayed water during operation of the dishwasher. The air gap and the resilient connection between the first wall plate and the wall provide localized attenuation of the noise from the drumming impact of the sprayed wash water.

10 Claims, 1 Drawing Sheet

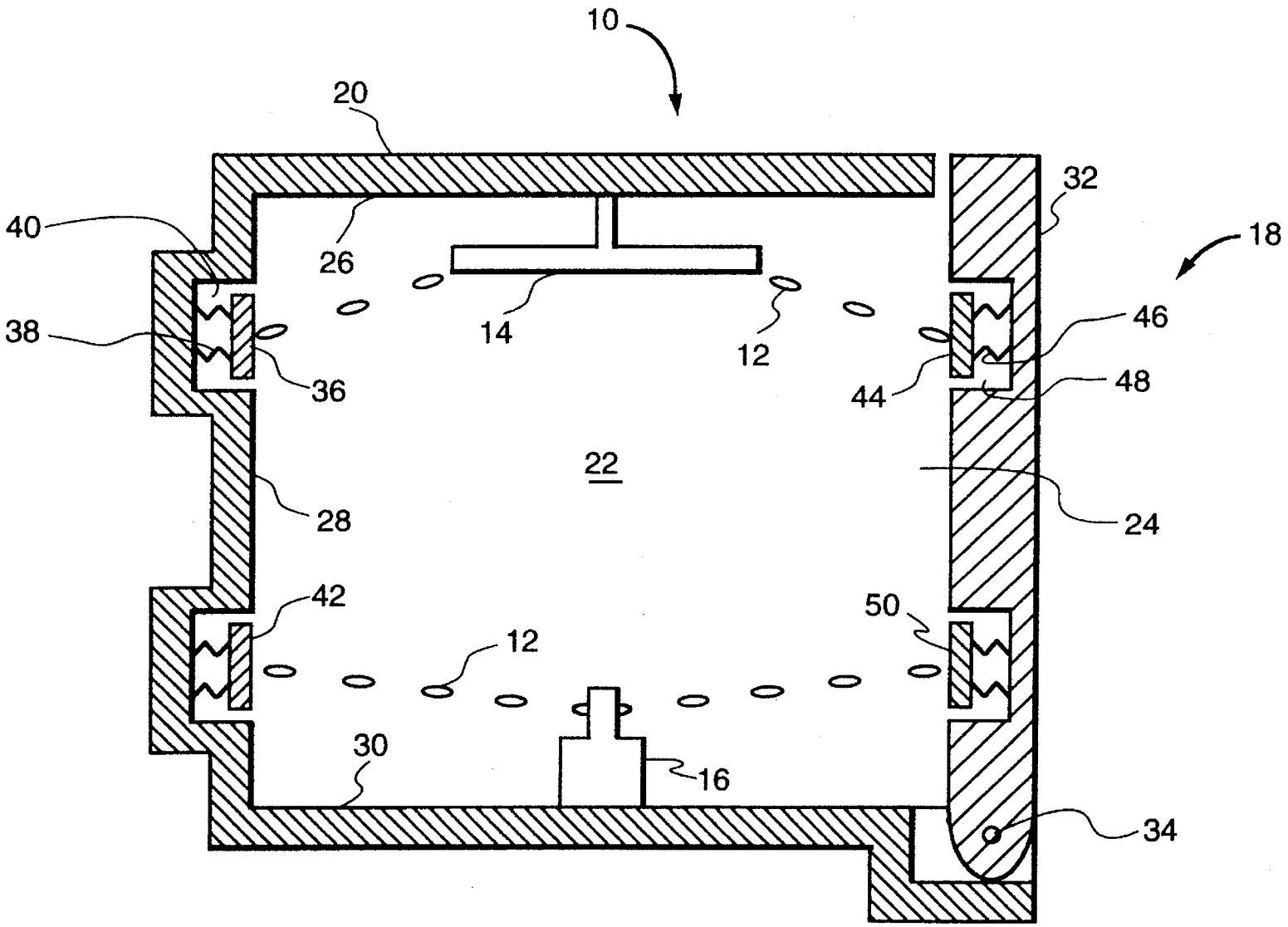
10
12
14
16
18
20
22
24
26
28
30
32
34
36
38
40
42
44
46
48
50

DISHWASHER MACHINE TUB WITH LOCALIZED NOISE ATTENUATION

BACKGROUND OF THE INVENTION

The present invention relates generally to dishwasher machines having dishwasher tubs, and more particularly to such a tub which attenuates dishwashing noise.

Conventional dishwasher machines automatically wash dishes in a dishwasher tub which typically is a light-weight plastic tub for cost, durability, and corrosion reasons. Such dishwasher machines produce noise including noise produced from the dishwashing operation inside the dishwasher tub. The conventional method for attenuating sound transmission through a plate-like structure is to increase its mass (or, more precisely, its surface density measured in units of mass per area). It is noted that increasing the bending stiffness makes the structure more conductive to sound, while making it less stiff will degrade the tub's structural integrity. The addition of mass in the form of thicker tub walls or added patches of damping material will attenuate sound an additional 6 dB for each doubling of the mass. This rapidly makes the tub heavier and more expensive for modest improvements in sound attenuation. A blanket of sound absorption material (e.g., loose fiberglass insulation) around the outside of the dishwasher tub in the space between the tub and the surrounding kitchen counter/cabinets will also attenuate noise. What is needed is a dishwasher tub for a dishwasher machine which further attenuates unwanted dishwashing noise.

SUMMARY OF THE INVENTION

It is an object of the invention to provide a dishwasher machine tub which attenuates dishwashing noise.

In a first preferred embodiment, the dishwasher machine tub of the invention is for containing water sprayed therein during operation of a dishwasher and includes a wall, a door, and a first wall plate. The wall defines a dishwashing chamber having an opening. The door is connected to the wall and may be positioned to cover and uncover the opening of the wall. The first wall plate is spaced apart from the wall, resiliently connected to the wall, and positioned within the dishwashing chamber.

In a second preferred embodiment, the dishwasher machine tub of the invention is for containing water sprayed therein during operation of a dishwasher and includes a wall, a door, and a first door plate. The wall defines a dishwashing chamber having an opening. The door is connected to the wall and may be positioned to cover and uncover the opening of the wall. The first door plate is spaced apart from the door, resiliently connected to the door, and positioned generally between the door and the dishwashing chamber when the door is positioned to cover the opening.

In exemplary embodiments, the first wall plate and the first door plate are located so as to be directly impinged by some of the sprayer water during operation of the dishwasher.

Several benefits and advantages are derived from the invention. Dishwashing noise includes localized noise caused by the drumming impact of the wash water sprayed on the wall. The first wall plate and the first door plate are positioned to be directly impinged by such sprayed water instead of the wall being directly impinged. The air gap and the resilient connection between the first wall plate and the wall and between the first door plate and the door provide localized attenuation of the noise from such drumming impact of the sprayed wash water more efficiently than by increasing the thickness of the wall or door.

BRIEF DESCRIPTION OF THE DRAWINGS

The accompanying drawing illustrates a preferred embodiment of the present invention wherein:

the Figure is a schematic side-elevational view of a dishwasher machine tub having first and second wall plates and first and second door plates.

DETAILED DESCRIPTION OF THE INVENTION

Referring now to the drawing, the Figure shows an embodiment of the dishwashing machine tub 10 of the invention which is for containing water 12 sprayed therein from dishwasher water nozzles 14 and 16 during operation of a dishwasher 18. The dishwasher machine tub 10 includes a wall 20 defining a dishwashing chamber 22 having an opening 24. Preferably, the wall 20 is a generally one-eighth inch thick plastic wall. Typically, the wall 20 has five generally planar sides, only three of which 26, 28, and 30 are shown in the Figure. The shape of the wall 20 is arbitrary as long as it defines the dishwashing chamber 22 where the dish racks (omitted from the Figure for clarity) are placed and where the dishes (also omitted from the Figure for clarity) are washed.

The dishwasher machine tub 10 also includes a door 32 connected to the wall 20 and disposable to cover and uncover the opening 24. Preferably, the door 32 is attached to the wall 20 by a hinge pin 34 allowing the door 32 to be rotated to open and close the dishwashing chamber 22. In an exemplary embodiment, the door 32 is a generally one-eighth inch thick plastic door.

In a first preferred embodiment of the invention, the dishwasher machine tub 10 further includes a first wall plate 36 spaced apart from the wall 20, resiliently connected to the wall 20, and disposed within the dishwashing chamber 22. Preferably, the first wall plate 36 is a generally one-eighth inch thick plastic wall plate and is spaced between generally one-fourth and generally one-half inch from the wall 20. The resilient connection of the first wall plate 36 to the wall 20 may include springs 38, rubber-like spacers (not shown in the Figure), cantilever-like supports (not shown in the Figure), and the like, as can be appreciated by those skilled in the art. Such a resilient (i.e., compliant) connection cuts down on structure-borne sound transmission from the first wall plate 36 to the wall 20. Ignoring such connection (since preferably the first wall plate 36 and the wall 20 have minimal structural contact with each other), the noise attenuation R (in decibels) of the dishwasher machine tub 10 in the locality of the first wall plate 36 is equal to the attenuations (in decibels) caused by the first wall plate 36 and the wall 20 plus the excess attenuation due to the air gap. Such air-gap attenuation is equal to 20 log (2 kd) where K is the wave number of the sound and d is the distance between the first wall plate 36 and the wall 20. Thus, the noise attenuation is increased by increasing the surface density of the first wall plate 36 and/or the wall 20 and/or by increasing the air gap separating the first wall plate 36 and the wall 20.

As can be appreciated by those skilled in the art, the dishwashing noise to be attenuated not only includes generalized noise from inside the dishwasher machine tub 10 during dishwashing operation but also includes localized noise caused by the drumming impact of the wash water spray on the wall 20. Preferably, the first wall plate 36 is disposed so as to be directly impinged by some of the sprayed water 12 during operation of the dishwasher 18. Thus, the first wall plate 36 intercepts some of the sprayed water 12 that would otherwise directly impinge on the wall 20, and the sound of the drumming impact of the wash water spray from inside the dishwashing machine tub 10 is thereby attenuated before being transmitted into the kitchen.

In a preferred construction, the wall 20 has an interior wall recess 40, and the first wall plate 36 is disposed generally entirely in the interior wall recess 40. The recess 40 maximizes the usable dishwashing volume inside the dishwashing chamber 22. Design details (not shown) for a particular application are left to the artisan. For example, the resilient connection of the first wall plate 36 to the wall 20 may be one which prevents water in the dishwashing chamber 22 from entering the space between the first wall plate 36 and the wall 20, with such space being filled with acoustic absorption material (such as loose fiberglass insulation) and with such wall 20 having a plurality of acoustic venting holes leading outward to the surrounding kitchen counter/cabinets to further reduce sound transmission.

In an exemplary embodiment, the dishwasher machine tub 10 further includes a second wall plate 42 disposed within the dishwashing chamber 22, spaced apart from the wall 20 and the first wall plate 36, and resiliently connected to the wall 20. The second wall plate 42 is disposed so as to be directly impinged by some of the sprayed water 12 during operation of the dishwasher 18. The second wall plate 42 is similar to the first wall plate 36 with detailed design differences for a particular application left to the artisan.

In a second preferred embodiment of the invention, the dishwasher machine tub 10 additionally includes a first door plate 44 spaced apart from the door 32, resiliently connected to the door 32, and disposed generally between the door 32 and the dishwashing chamber 22 when the door 32 is disposed to cover the opening 24 of the wall 20. Preferably, the first door plate 44 is a generally one-eighth inch thick plastic door plate and is spaced between generally one-fourth and one-half inch from the door 32. The resilient connection of the first door plate 44 to the door 32 may include springs 46, rubber-like spacers (not shown in the Figure), cantilever-like supports (not shown in the Figure), and the like, as can be appreciated by those skilled in the art. Such a resilient (i.e., compliant) connection cuts down on sound transmission. Ignoring such connection (since preferably the first door plate 44 and the door 32 have minimal structural contact with each other), the noise attenuation R (in decibels) of the dishwasher machine tub 10 in the locality of the first door plate 44 is equal to the attenuations (in decibels) caused by the first door plate 44 and the door 32 plus the excess attenuation due to the air gap. Such air-gap attenuation is equal to 20 log (2 kd) where K is the wave number of the sound and d is the distance between the first door plate 44 and the door 32. Thus, the noise attenuation is increased by increasing the surface density of the first door plate 44 and/or the door 32 and/or by increasing the air gap separating the first door plate 44 and the door 32.

As previously mentioned, the dishwashing noise to be attenuated not only includes generalized noise from inside the dishwasher machine tub 10 during dishwashing operation but also includes localized noise, this time caused by the drumming impact of the wash water spray on the door 32. Preferably, the first door plate 44 is disposed so as to be directly impinged by some of the sprayed water 12 during operation of the dishwasher 18. Thus, the first door plate 44 intercepts some of the sprayed water 12 that would otherwise directly impinge on the door 32, and the sound of the drumming impact of the wash water spray from inside the dishwashing machine tub 10 is thereby attenuated before being transmitted into the kitchen.

In a preferred construction, the door 32 has an interior door recess 48, and the first door plate 36 is disposed generally entirely in the interior door recess 48. The recess 48 maximizes the usable dishwashing volume inside the dishwashing chamber 22 when the door 32 is closed. Design details (not shown) for a particular application are left to the artisan. For example, the resilient connection of the first door plate 44 to the door 32 may be one which prevents water in the dishwashing chamber 22 from entering the space between the first door plate 44 and the door 32, with such space being filled with acoustic absorption material (such as loose fiberglass insulation) to further reduce sound transmission.

In an exemplary embodiment, the dishwasher machine tub 10 additionally includes a second door plate 50 spaced apart from the door 32 and the first door plate 44, resiliently connected to the door 32, and disposed generally between the door 32 and the dishwashing chamber 22 when the door 32 is disposed to cover the opening 24 of the wall 20. The second door plate 50 is disposed so as to be directly impinged by some of the sprayed water 12 during operation of the dishwasher 18. The second door plate 50 is similar to the first door plate 44 with detailed design differences for a particular application left to the artisan.

It is noted that the precise locations of the wall and door plates 36, 42, 44, and 50 may be analytically and/or experimentally determined. It is preferred that such locations be ones which will be directly impinged by some of the sprayed water 12 and not ones which will be blocked from the sprayed water 12 by intervening dishes for typical dish loadings.

Applicants have conducted both analytical and experimental tests on prototype dishwasher machine tubs similar to the dishwasher machine tub 10 of the invention having first and second wall plates 36 and 42 and first and second door plates 44 and 50. A statistical energy analysis of the tub produced an overall noise improvement, over the conventional single wall construction, of 9 dB (decibels). A physical prototype based on the model used for such analysis showed an improvement of 6 dB.

The foregoing description of a preferred embodiment of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

We claim:

1. A dishwasher machine tub for containing water sprayed therein during operation of a dishwasher, said dishwasher tub comprising:

a) a wall defining a dishwashing chamber having an opening;

b) a door connected to said wall and disposable to cover and uncover said opening; and c) a first wall plate spaced apart from said wall, resiliently connected to said wall, and disposed within said dishwashing chamber.

2. The dishwasher machine tub of claim 1, wherein said first wall plate is disposed so as to be directly impinged by some of said sprayed water during operation of said dishwasher.

3. The dishwasher machine tub of claim 2, wherein said wall has an interior wall recess, and wherein said first wall plate is disposed generally entirely in said interior wall recess.

4. The dishwasher machine tub of claim 3, also including a second wall plate disposed within said dishwashing chamber, spaced apart from said wall and said first wall plate, and resiliently connected to said wall, and wherein said second wall plate is further disposed so as to be directly impinged by some of said sprayed water during operation of said dishwasher.

5. A dishwasher machine tub for containing water sprayed therein during operation of a dishwasher, said dishwasher tub comprising:

a) a wall defining a dishwashing chamber having an opening;

b) a door connected to said wall and disposable to cover and uncover said opening; and c) a first door plate spaced apart from said door, resiliently connected to said door, and disposed generally between said door and said dishwashing chamber when said door is disposed to cover said opening of said wall.

6. The dishwasher machine tub of claim 5, wherein said first door plate is disposed so as to be directly impinged by some of said sprayed water during operation of said dishwasher.

7. The dishwasher machine tub of claim 6, wherein said door has an interior door recess, and wherein said first door plate is disposed generally entirely in said interior door recess.

8. The dishwasher machine tub of claim 7, also including a second door plate spaced apart from said door and said first door plate, resiliently connected to said door, and disposed generally between said door and said dishwashing chamber when said door is disposed to cover said opening, and wherein said second door plate is further disposed so as to be directly impinged by some of said sprayed water during operation of said dishwasher.

9. A dishwasher machine tub for containing water sprayed therein during operation of a dishwasher, said dishwasher tub comprising:

a) a wall defining a dishwashing chamber having an opening;

b) a door connected to said wall and disposable to cover and uncover said opening;

c) a first wall plate spaced apart from said wall, resiliently connected to said wall, and disposed within said dishwashing chamber; and d) a first door plate spaced apart from said door, resiliently connected to said door, and disposed generally between said door and said dishwashing chamber when said door is disposed to cover said opening of said wall.

10. The dishwasher machine tub of claim 9, wherein said wall has an interior wall recess and said door has an interior door recess, and wherein said first wall plate is disposed generally entirely in said interior wall recess and said first door plate is disposed generally entirely in said interior door recess.

* * * * *